United States Patent [19]

Carr et al.

[11] Patent Number: 4,856,705

[45] Date of Patent: Aug. 15, 1989

[54] AUTOMATICALLY-OPERATING BOTTOM STRUCTURE

[75] Inventors: Timothy H. Carr, Niagara Falls; Donald W. Felton, Buffalo, both of N.Y.

[73] Assignee: Lawless Container Corporation, North Tonawanda, N.Y.

[21] Appl. No.: 250,912

[22] Filed: Sep. 29, 1988

[51] Int. Cl.[4] ..... B65D 5/36

[52] U.S. Cl. ..... 229/109; 229/41 C; 229/117

[58] Field of Search ..... 229/109, 41 R, 41 B, 229/41 C, 41 D, 117

[56] References Cited

U.S. PATENT DOCUMENTS

| | | | |
|---|---|---|---|
| 3,565,325 | 2/1971 | Pugsley | 229/41 B |
| 3,642,192 | 2/1972 | Wilcox, Jr. et al. | 229/41 B |
| 4,199,098 | 4/1980 | Lopez | 229/41 C |
| 4,260,100 | 4/1981 | Hoffman | 229/109 |
| 4,289,267 | 9/1981 | Mayea | 229/39 R |
| 4,549,690 | 10/1985 | Rosenburg | 229/41 C |

FOREIGN PATENT DOCUMENTS

| | | | |
|---|---|---|---|
| 1354881 | 2/1964 | France | 229/41 C |
| 472044 | 6/1952 | Italy | 229/41 B |

OTHER PUBLICATIONS

"Corrugated Box Style Reference", Post Machinery Co., Inc., Post Road, Portsmouth, N.H. 03801 (undated).

*Primary Examiner*—Gary Elkins

*Attorney, Agent, or Firm*—Sommer & Sommer

[57] ABSTRACT

An automatically-operated bottom structure for an eight-sided container includes a pair of bottom flaps (66,69) pivotally connected to pair of opposed first panels (13,18), and band pivotally connected to an opposed pair of second panels (11,15) arranged substantially perpendicular to the first panels. The band and bottom flaps are folded within the container when the container is in a folded-flat condition, but are adapted to automatically form an operative bottom structure when the folded-flat container is moved to a fully-expanded condition.

13 Claims, 3 Drawing Sheets

10
11
12
13
14
15
16
18
19
20
21
22
23
24
25
26
28
29
30
31
32
33
34
35
36
38
39
40
41
42
43
44
45
46
48
49
50
51
52
53
54
55
56
58
59
60
61
62
63
64
65
66
68
69
70
71
72
73
74
75
76
78
79
80
81
82
83
84
85
86
88
89
90
91
92
93
94
95
96
98
99
100
101
73'
74'
75'
76'
78'
79'
80'
81'
82'
83'
84'
85'
86'
88'
89'
95'
96'
98'
99'

AUTOMATICALLY-OPERATING BOTTOM STRUCTURE

TECHNICAL FIELD

This invention relates generally to the field of collapsible containers having 4n sides (where n is a whole integer greater than one), and, more particularly, to an improved bottom structure for such a polygonal container which is adapted to move automatically to an operative position when the container is moved from a folded-flat condition to a fully-expanded condition.

BACKGROUND ART

Boxes and containers, whether formed of cardboard or corrugated paper, abound in modern society, and are used to store a wide variety of objects.

Many boxes, such as those commonly seen in the supermarket, have a single rectangular shape, and are formed by providing a blank with a plurality of top and/or bottom flaps which are adapted to be selectively folded to overlap one another. A suitable adhesive or tape is used to hold selected flaps in their operative overlapped positions with respect to other flaps. These boxes are usually shipped in a folded-flat condition and assembled immediately prior to use. Otherwise, the volume occupied thereby would unnecessarily consume space.

In recent years, special-purpose boxes have been developed to house uniquely-shaped articles, and for marketing and display purposes. For example, an eight-sided box has been developed heretofore, for example, to house and contain lamp bases and the like. However, it would generally be desirable to ship the empty box in a folded-flat condition simply to reduce the volume occupied thereby. The box may then be suitably manipulated or moved from such folded-flat condition to a fully-expanded condition immediately prior to insertion of the object to be contained therein. It would also be desirable to provide a box in which the bottom would form automatically as the box is moved from its folded-flat condition to its fully-expanded condition.

Others have attempted to provide an eight-sided box having an automatically-operated bottom structure. Details of such earlier forms of construction are shown in U.S. Pat. Nos. 4,549,690, 4,199,098 and 4,289,267. Other types of polygonal boxes, and blanks therefor, are shown in the publication, "Corrugated Box Style Reference", Post Machinery Company, Inc., Portsmouth, N.H. 03801 (undated).

DISCLOSURE OF THE INVENTION

The present invention provides an improved automatically-operating bottom structure for a collapsible box-like container which is adapted to be selectively moved between a folded-flat condition and fully-expanded condition. The container has 4n side panels, where n is an integer of one or more. The several side panels are of substantially equal width, and are pivotally connected along their adjacent longitudinal edges so as to be arranged in series with one another. These panels are arranged in diametrically-opposite pairs when the container is in its fully-expanded condition.

The improvement broadly comprises: a bottom flap pivotally connected to each of a pair of first panels which are arranged to be opposed from one another when the container is in its fully-expanded condition, each bottom flap forming an included angle of about 0° with respect to its associated first panel when the container is in its folded-flat condition and forming an included angle of about 90° with respect to associated first panel when the container is in its fully-expanded condition; each of the first panels and its associated bottom flap being folded about a longitudinal axis substantially midway between the longitudinal boundaries (i.e., edges or fold lines) of the first panel, the respective halves of the first panels being arranged at an included angle of about 0° when the container is its folded-flat condition and being arranged at an included angle of about 180° when the container is in its fully-expanded condition; and a band pivotally connected to each of pair of second panels which are arranged to be substantially perpendicular to the first panels when the container is in its fully-expanded condition, the band having two sections pivotally connected to one another about at least one intermediate pivotal axis substantially parallel to the pivotal axes between the band and the second panels, the band sections being arranged with respect to one another at an included angle of about 0° when the container is in its folded-flat condition and being arranged with respect to one another at an included angle of about 180° when the container is in its fully-expanded condition; whereby when the container is moved from its folded-flat condition to its fully-expanded condition, the band will prevent the flaps from moving pivotally relative to their associated first panels through an angle more than about 90°.

Accordingly, the general object of this invention is to provide an improved automatically-operating bottom structure for a polygonal box or container having four n sides, where n is an integer of one or more.

Another object is to provide an improved automatically-operating bottom structure for a package, in which a pair of opposing bottom flaps are caused to interlock with one another.

Another object is to provide an improved automatically-operating bottom structure for such a package in which a band extends beneath the interlocked bottom flaps to strengthen the bottom structure of the package.

These and other objects and advantages will become apparent from the foregoing and ongoing written specification, the drawings, and the appended claims.

MODE(S) OF CARRYING OUT THE INVENTION

Figure 1:
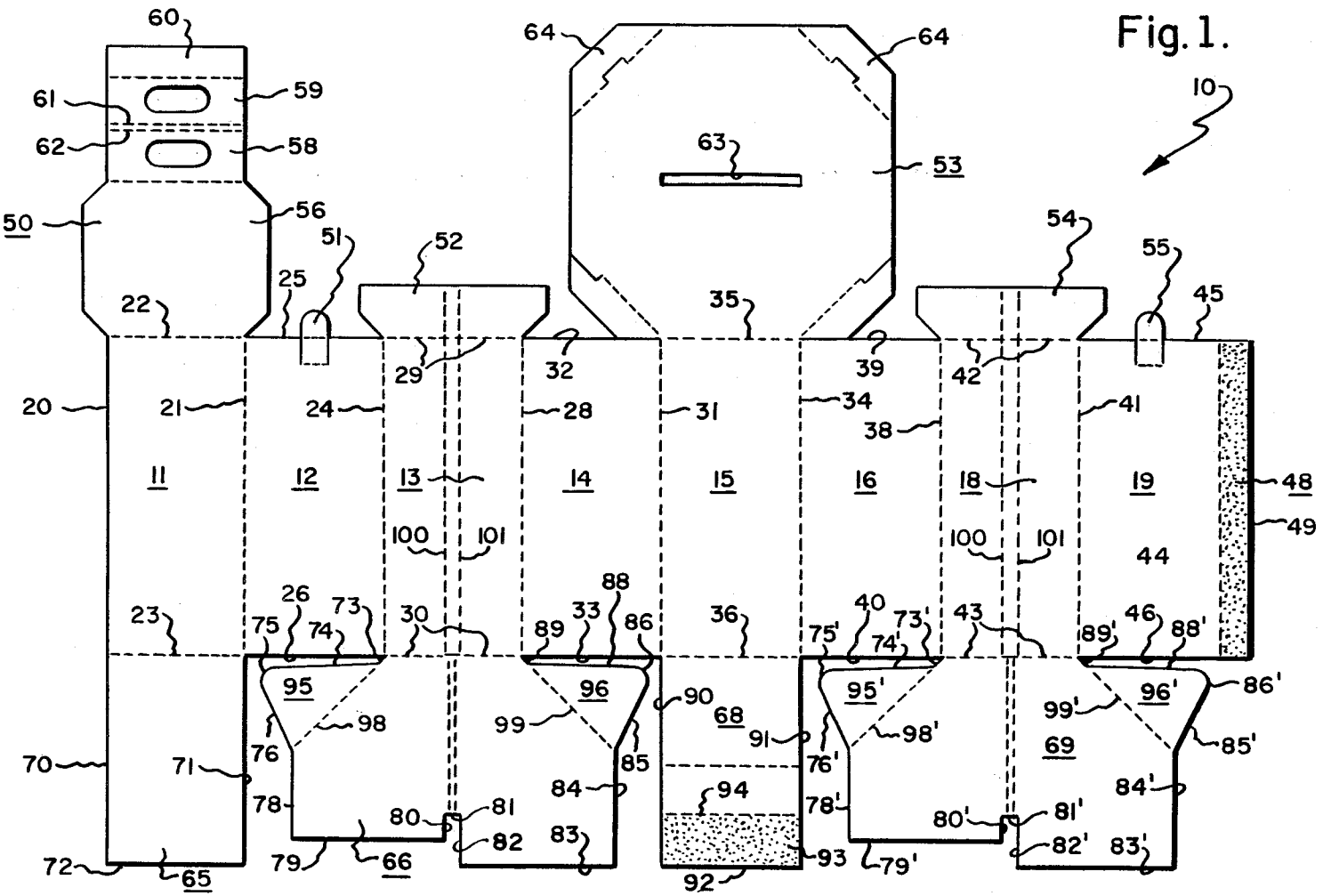
FIG. 1 is top plan view of a planar blank from which an eight-sided container incorporating the improved automatically-operating bottom structure is to be formed, this view showing the various flaps, band sections, tabs and score lines about which adjacent portions are to be folded.
Figure 2:
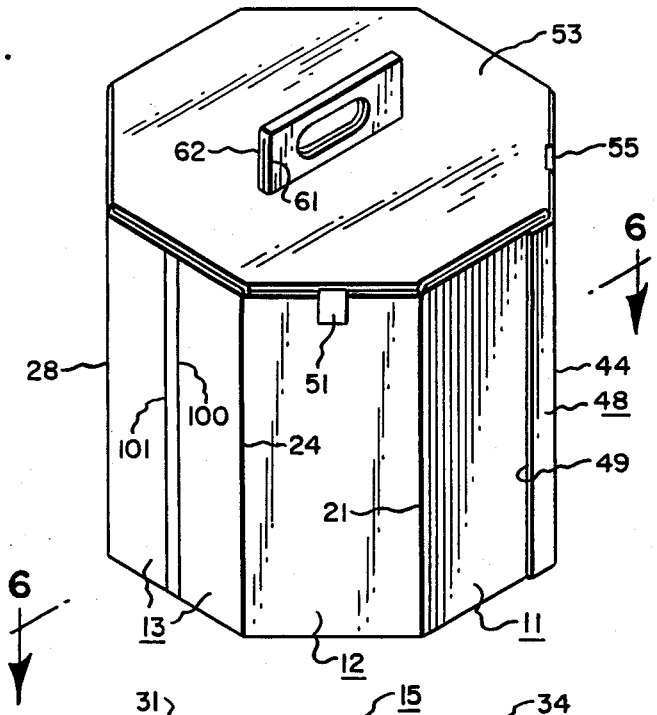
FIG. 2 is an isometric view of the fully-expanded container, this view looking downwardly at the left front corner thereof.

At the outset, it should be clearly understood that like reference numerals are intended to identify the same parts, portions or surfaces consistently throughout the several drawing figures, as such parts, portions or surfaces may be further described or explained by the entire written specification, of which this detailed description is an integral part. Unless otherwise indicated, the drawings are intended read (e.g., cross-hatching, arrangement of parts, proportion, degree, etc.) together with the specification, and are to be considered a portion of the entire "written description" of this invention, as required by 35 U.S.C. §112. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing faces the reader. Similarly, the terms "inwardly" and "outwardly" simply refer to the orientation of a surface relative to its axis of elongation, or axis of rotation, as appropriate.

Referring now to the drawings, this invention provides an improved automatically-operating bottom structure for a collapsible container having 4n sides, where n is a whole integer of one or more. Thus, the container may have 4, 8, 12, . . . 4n sides. However, the invention will be described with reference to an octagonal container, which is regarded as the presently-preferred embodiment.

Referring now to FIG. 1, this view shows a planar blank 10 which may be die-cut from suitable feed stock (not shown), such as cardboard, chip board, single- or double-faced corrugated paper, or the like. The particular material of which the container is formed is not deemed to be critical. However, the preferred embodiment is shown as being formed of double-faced corrugated paper having a thickness of about ⅛ inch [3.175 mm]. In any event in the accompanying drawings, score lines about which adjacent panels or portions are to be folded are represented by dashed lines, while throughcuts are represented by solid lines.

Blank 10 is shown as having a horizontally-elongated rectangular central portion formed by eight vertically-elongated rectangular panels, individually indicated at 11–16 and 18–19, which are arranged side-by-side as to be connected in series with one another. Thus, left panel 11 is bounded by left vertical edge 20, right vertical fold line 21, and upper and lower horizontal fold lines 22,23, respectively; panel 12 is bounded left and right vertical fold lines 21,24, and by upper and lower horizontal edges 25,26, respectively; panel 13 is bounded by left and right vertical fold lines 24,28, and by upper and lower horizontal fold lines 29,30, respectively; panel 14 is bounded by left and right vertical fold lines 28,31, and by upper and lower horizontal edges 32,33, respectively; panel 15 is bounded by left and right vertical fold lines 31,34, and by upper and lower horizontal fold lines 35,36, respectively; panel 16 is bounded by left and right vertical fold lines 34,38, and by upper and lower horizontal edges 39,40, respectively; panel 18 is bounded by left and right fold lines 38,41, and by upper and lower horizontal fold lines 42,43, respectively; and right panel 19 is bounded by left and right vertical fold lines 41,44, and by upper and lower horizontal edges 45,46, respectively. Each of these eight panels is of substantially constant width and height. Thus, left edge 20, right edge 49, and intermediate vertical score lines 21,24,28,31,34,38,41 and 44 are substantially parallel to one another, and are of substantially the same longitudinal extent. Similarly, the alternating upper fold lines 22,29,35,42 and upper edges 25,32,39,45 are represented as lying in one common horizontal line, and the alternating lower fold lines 23,30,36,43 and lower edges 25,32,39,45 are represented as lying in another common horizontal line. However, depending upon the particular thickness of the feed stock of which the blank is formed, this may have to be changed. For example, if the feed stock is relatively thick, the fold lines may have to be slightly offset from the adjacent edges to allow sufficient material for flexure about the fold or score lines.

A vertically-elongated relatively-narrow glue tab 48 extends rightwardly from right panel 19. Specifically, this glue tab is bounded by left fold line 44, right vertical edge 49, and by extensions of upper and lower horizontal edges 45,46, respectively. A suitable adhesive is applied to the obverse surface of the this glue tab. Hence, when the adjacent panels are severally bent upwardly (i.e., out of the plane of the paper) through angles of about 45° relative to their next-adjacent panels, this glue tab will overlap the left marginal end portion of the outwardly-facing surface (i.e., the reverse surface in FIG. 1) of left panel 11 when the container is assembled, as shown in FIGS. and 4–6. Ideally each adjacent panel should be bent or folded about the intermediate fold lines so as to be inclined with respect to its immediately-adjacent neighboring panels by acute included angles of about 45°, thereby to form a regular octagon.

Adverting now to FIG. 1, the top structure is shown as including a handle flap, generally indicated at 50, extending upwardly from upper fold line 22; a locking tab 51 formed in, and extending upwardly from, panel 12; a dust flap 52 extending upwardly from score line 29; a top panel, generally indicated at 53, extending upwardly from score line 35; a dust flap 54 extending upwardly from score line 42; and another locking tab 55 formed in, and extending upwardly from, panel 19. The handle flap 50 has an intermediate or connecting portion 56, two handle portions 58,59, and a distal end portion 60. The handle portions are adapted to be folded about intermediate score lines 61,62, so as to form a handle which may be passed through the central slot 63 of top panel 53. Dust flaps 52,54, are adapted to be reversely folded into the container (i.e., out of the plane of the paper, as seen in FIG. 1). Hexagonal top panel 53 has four generally-trapezoidal tuck tabs, severally indicated at 64, arranged at the alternating edges thereof, which are adapted to be folded into the container when the top is closed. However, since the top structure is deemed to be collateral to the improved automatically-operating bottom structure, the top structure will not be further described.

The improved bottom structure is shown as broadly including a first band flap 65 extending downwardly from score line 23, a first bottom flap 66 extending downwardly from score line 30, a second band flap 68 extending downwardly from score line 36, and a second bottom flap 69 extending downwardly from score line 43.

First band flap 65 is shown as being a vertically-elongated rectangular member joined to panel 11 via score line 23, and having a left vertical edge 70, a right vertical edge 71, and a lower horizontal edge 72. This first band flap is adapted to be folded through an angle of about 90° out of the paper relative to panel section 11 when the container is formed.

The first bottom flap 66 is shown as being a specially-configured member joined to panel 13 via intermediate score line 30. This first flap is sequentially bounded by (in a counter-clockwise direction); a leftwardly- and upwardly-facing inclined planar surface 73 extending downwardly and leftwardly from the right margin of edge 26, a slightly-inclined planar edge 74 extending leftwardly therefrom, a rounded or convex tip edge 75, a downwardly- and leftwardly-facing edge 76, a leftwardly-facing vertical edge 78, a downwardly-facing horizontal edge 79, a rightwardly-facing vertical edge 80, a downwardly-facing horizontal edge 81, a leftwardly-facing vertical edge 82 extending downwardly beyond edge 79, a downwardly-facing horizontal edge 83, a rightwardly-facing vertical edge 84, a downwardly- and rightwardly-facing edge 85, a rounded or convex edge 86, a slightly-inclined edge 88 extending leftwardly therefrom, and a rightwardly- and upwardly-facing edge 89 continuing upwardly therefrom to join the left margin of lower edge 33.

The second band flap 68 is shown as being a vertically-elongated rectangular member extending downwardly from panel 15 via intermediate score line 36. This second band flap is shown as being bounded by a left vertical edge 90, a right vertical edge 91, and downwardly-facing horizontal edge 92 extending therebetween. A lower marginal portion 93 (i.e., between horizontal fold line 94 and bottom edge 92) of the reverse surface thereof is provided with a suitable adhesive to provide a means by which the two flap sections may be joined together to provide an assembled band, as described infra.

The second bottom flap 69 is shown as being a specially-configured member extending downwardly from panel 18 via intermediate score line 43. Second bottom panel 69 is substantially the same configuration as first panel section 66. Hence, the primes (i.e., ') of the same reference numerals previously used are again used to identify such previously-described structure.

Blank 10 is formed integrally from a length of feed stock so as to have the shape and fold or score lines shown in FIG. 1. For the benefit those not skilled in this art, a score or fold line is simply an indentation made in the obverse or reverse surface of the feed stock, as appropriate, which indentation then forms a pivotal web about which adjacent portions of the blank may be folded. While such fold lines are schematically represented by dashed lines in FIG. 1, they may be of such actual width as may be necessary to permit folding of such adjacent portions.

Figure 3:
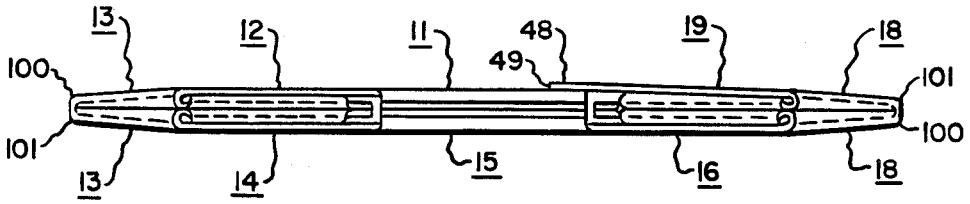
FIG. 3 is a bottom plan view of the improved container in its folded-flat condition.

In any event, the triangular corner flaps 95,96,95',96' are folded out of the plane of the paper through angles of approximately 180° about score lines 98,99,98',99', respectively, so that the obverse surfaces of these flaps are arranged to engage the obverse surfaces of the bottom flaps, all as seen in FIG. 1. Thereafter, the four flaps which extend downwardly from the serially-connected panels, are folded upwardly out of the plin of the paper so that the obverse surfaces of these downwardly-extending flaps are arranged to engage the facing obverse surfaces, again as seen in FIG. 1, of panels 11,13,15,18. Band flaps 65,68 are folded upwardly about score lines 23,36, respectively. Similarly, bottom flaps 66,69, with their respective triangular corner flaps prefolded, are folded about score lines 30,43, respectively. The serially-connected panels 11–16 and 18–19 are then bent to form a regular octagon, with glue tab 48 overlapping the reverse surface of the left marginal end portion of panel 11. Thereafter, the thus-formed container is folded flat, as shown in FIG. 3, about longitudinal score lines 100,101 extending substantially midway between the lateral edges of tuck tab 52, panel 13 and first bottom flap 66, and longitudinal score lines 100',101' extending substantially midway between the lateral edges of tuck tab 54, panel 18, and second bottom flap 69. In this folded-flat condition, the adhesive on the marginal end portion of the reverse surface of second band flap 68 will engage the approximate facing surface of first band flap 65. Thus, the four flaps forming the bottom structure are all tucked within the folded-flat container.

Figure 6:
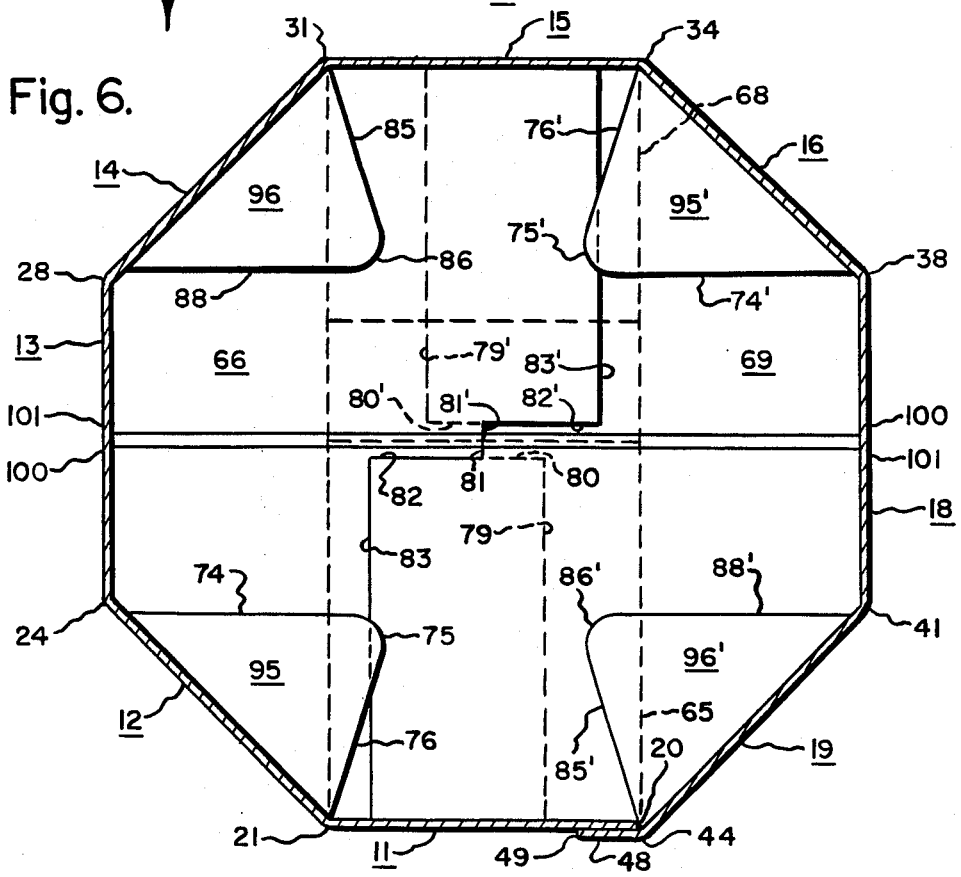
FIG. 6 is an enlarged horizontal sectional view thereof, taken generally on line 3—3 of FIG. 2, and looking downwardly at the bottom structure when the container is in its fully-expanded condition.
Figure 4:
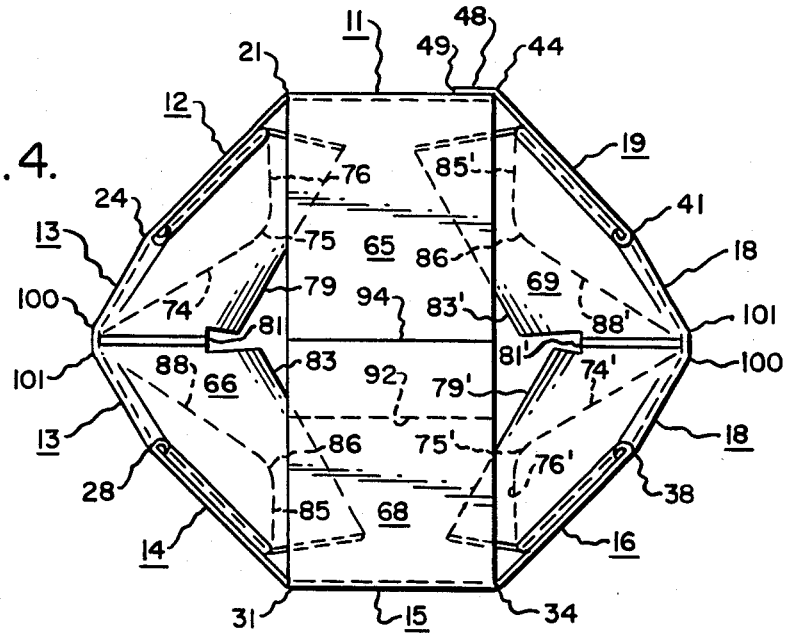
FIG. 4 is a bottom plan view of the improved container, showing the same as being in a position intermediate its folded-flat and fully-expanded conditions.
Figure 5:
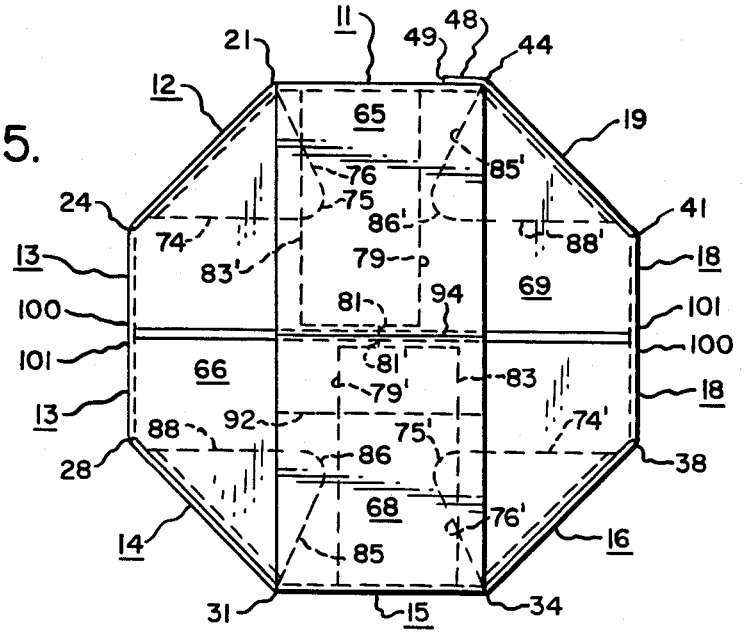
FIG. 5 is bottom plan view of the improved container in its fully-expanded condition.

An operator may move the folded-flat blank to its fully-expanded condition simply by inserting his hands into the top portion, and expanding them to form the fully-expanded condition. As this occurs, the band flap, formed by connected band flap section 65,68, spans the transverse distance between opposing panels 11,15. The bottom flap panels then fold downwardly and fit interdigitally with one another, as shown in FIGS. 4–6. It will be appreciated that the band prevents the bottom flap panels from pivoting more than about 90° relative to panels 11,15, respectively. Thereafter, the top may be formed.

The container may be moved back from its fully-expanded condition to its folded-flat condition by simply reversing the sequence of steps outlined above.

Modifications

The present invention contemplates that many changes and modifications may be made. As previously indicated, the particular material of which the box or container is formed is not deemed critical. This may be formed of cardboard, single- or double-faced corrugated paper, or some other material, as desired. The particular structure of the top is deemed collateral to an understanding of the improved bottom, described and claimed herein.

The corner flaps of the improved bottom, while preferable, need not be invariably provided. It is also preferred, but not absolutely necessary, that the two bottom panels fit interdigitally with one another. The triangular corner flaps 95,96 are also deemed preferable, but may be omitted if desired. Also, the band has been described as being formed of two sections, subsequently glued together, only for manufacturing convenience. If desired, the band could be formed as single member pivotally attached to one panel and having a glue tab at its distal end which is engageable with the opposite panel.

Therefore, while the preferred embodiment of the improved automatically-operating bottom structure has been shown and described, and several modifications and changes thereof discussed, persons skilled in this art will readily appreciate that various additional changes and modifications may be made without departing from the spirit of the invention, as defined and differentiated by the following claims.

We claim:

1. An automatically-operating bottom structure for a collapsible container adapted to be selectively moved between a folded-flat condition and a fully-expanded condition, said container having 4n rectangular side panels where n is an integer of one or more, said panels being of substantially equal width and being pivotally connectd along their adjacent longitudinal edges so as to be arranged in series with one another, said panels being arranged in opposing pairs when said container is in said fully-expanded condition, the improvement which comprises:

a bottom flap pivotally connected of each of a first pair of said panels, each bottom flap forming an included angle of about 0° with respect to its associated first panel when said container is in said folded-flap condition and forming an included angle of about 90° with respect to its associated panel when said container is in said fully-expanded condition;

each of said first pair of panels and is associated bottom flap being folded about a longitudinal axis substantially midway between the longitudinal edges of said panel, the respective halves of said first pair of panels being arranged at an included angle of about 0° when said container is in said folded-flat condition and being arranged at an included angle of about 180° when said container is in said fully-expanded condition;

a band pivotally connected to each of a second pair of said panels arranged substantially perpendicular to said first pair of panels, said band having two sections pivotally connected to one another about an intermediate pivotal axis substantially parallel to the pivotal axes between said band and said second pair of panels, said sections being arranged with respect to one another at an included angle of about 0° when said container is in said folded-flat condition and being arranged with respect to one another at an included angle of about 180° when said container is said fully-expanded condition; and interlock means for interlocking said bottom flaps when said container is in said fully-expanded condition;

whereby when said container is moved from said folded-flat condition to said fully-expanded condition, said band will prevent said flaps from moving pivotally relative to their associated first panels through an angle of more than about 90°.

2. An automatically-operating bottom structure as set forth in claim 1 wherein the pivotal axes between said band and said second pair of panels are arranged in a common plane.

3. An automatically-operating bottom structure as set forth in claim 2 wherein the pivotal axes between said bottom flaps and said first pair of panels are substantially arranged in said plane.

4. An automatically-operating bottom structure as set forth in claim 3 wherein said container has eight side panels.

5. An automatically-operating bottom structure as set forth in claim 4 wherein every other one of said panels terminates in an edge which is substantially arranged in said plane.

6. An automatically-operating bottom structure as set forth in claim 5 and further comprising:

a pair of triangular flaps pivotally connected to an end of said bottom flaps, each of said triangular flaps being arranged at an angle of about 0° with respect to its associated bottom flap when said container is in said folded-flat condition and being arranged at an angle of about 90° with respect to its associated bottom flap when said container is in said fully-expanded condition.

7. An automatically-operating bottom structure as set forth in claim 6 wherein each of said triangular flaps is adapted to be arranged substantially parallel to the adjacent panel when said container is in said fully-expanded condition.

8. An automatically-operating bottom structure as set forth in claim 1 wherein said container is formed of paper.

9. An automatically-operating bottom structure as set forth in claim 8 wherein said pivotal axes are formed by folding said paper.

10. An automatically-operating bottom structure as set forth in claim 8 wherein said paper includes a corrugated portion.

11. An automatically-operating bottom structure as set forth in claim 1 wherein said band sections are formed with their associated panels, and said sections are adhesively secured together.

12. An automatically-operating bottom structure as set forth in claim 1 wherein said interlock means includes a notch formed in each of said bottom flaps to accommodate an overlapped marginal portion of the other of said flaps.

13. An automatically-operating bottom structure as set forth in claim 1 wherein each of said bottom flaps is formed integrally with the associated panel.

* * * * *